US008389104B2

(12) United States Patent
Day et al.

(10) Patent No.: US 8,389,104 B2
(45) Date of Patent: Mar. 5, 2013

(54) COMPOSITE CORES AND PANELS

(75) Inventors: Stephen W. Day, Centerville, OH (US); Michael S. Sheppard, Centerville, OH (US)

(73) Assignee: Milliken & Company, Spartanburg, SC (US)

( * ) Notice: Subject to any disclaimer, the term of this patent is extended or adjusted under 35 U.S.C. 154(b) by 265 days.

(21) Appl. No.: 12/924,612

(22) Filed: Sep. 30, 2010

(65) Prior Publication Data

US 2011/0081518 A1 Apr. 7, 2011

Related U.S. Application Data

(60) Provisional application No. 61/278,075, filed on Oct. 2, 2009.

(51) Int. Cl.
*B32B 33/00* (2006.01)
*B32B 5/12* (2006.01)

(52) U.S. Cl. ..... 428/153; 416/223 R; 416/227 A; 416/232

(58) Field of Classification Search ..... 428/153; 416/223 R, 227 A, 232
See application file for complete search history.

(56) References Cited

U.S. PATENT DOCUMENTS

| | | | | |
|---|---|---|---|---|
| 2,053,173 | A | 9/1936 | Astima | 88/24 |
| 2,062,590 | A | 12/1936 | Lundquist | 41/23 |
| 2,493,032 | A | 1/1950 | Rheinfrank, Jr. | 154/125 |
| 3,192,099 | A | 6/1965 | Beckman et al. | 161/43 |
| 3,230,995 | A | 1/1966 | Shannon | 156/166 |
| 3,243,492 | A | 3/1966 | Voelker | 264/346 |
| 3,246,058 | A | 4/1966 | Voelker | 264/47 |
| 3,264,153 | A | 8/1966 | Rodman et al. | 156/79 |
| 3,298,892 | A | 1/1967 | Lippay | 161/38 |
| 3,339,326 | A | 9/1967 | Derr et al. | 52/309 |
| 3,472,728 | A | 10/1969 | Hitch | 161/69 |
| 3,526,556 | A | 9/1970 | Berner | 156/79 |
| 3,544,417 | A | 12/1970 | Corzine | |
| 3,549,449 | A | 12/1970 | Windecker | 156/254 |
| 3,567,541 | A | 3/1971 | Kaczerginski | 156/172 |
| 3,697,633 | A | 10/1972 | Edgar | 264/45 |
| 3,708,385 | A | 1/1973 | Immethun | 161/69 |
| 3,733,235 | A | 5/1973 | Light et al. | 156/260 |
| 3,734,811 | A | 5/1973 | Small et al. | 161/37 |
| 3,750,355 | A | 8/1973 | Blum | 52/309 |
| 3,773,604 | A * | 11/1973 | Desai et al. | 220/560.05 |
| 3,841,958 | A | 10/1974 | Delorme | 161/161 |
| 3,867,238 | A | 2/1975 | Johannsen | 161/37 |

(Continued)

FOREIGN PATENT DOCUMENTS

| | | |
|---|---|---|
| CA | 446910 | 2/1948 |
| CA | 658023 | 2/1963 |

(Continued)

*Primary Examiner* — Brent O'Hern
(74) *Attorney, Agent, or Firm* — Cheryl J. Brickey

(57) ABSTRACT

A composite core panel has opposite side surfaces for receiving skins to form a composite sandwich panel. The core panel includes a plurality of spaced blocks of low density cellular material such as foam plastics and have opposite side surfaces forming the side surfaces of the core panel and opposite edge surfaces extending between the side surfaces. A plurality of parallel spaced elongated primary strips of structural cellular material such as balsa wood or engineered foam have a higher density and extend between the blocks, and the blocks have side surfaces adhesively attached to edge surfaces of the blocks. A plurality of parallel spaced secondary strips of structural high density cellular material such as balsa wood or engineered foam extend transversely to the primary strips and have end surfaces adhesively attached to the primary strips and side surfaces adhesively attached to the blocks.

5 Claims, 1 Drawing Sheet

U.S. PATENT DOCUMENTS

| | | | | |
|---|---|---|---|---|
| 3,906,137 | A | 9/1975 | Bauer | 428/315 |
| 4,042,746 | A | 8/1977 | Hofer | 428/311 |
| 4,048,365 | A | 9/1977 | Hoover | 428/215 |
| 4,093,762 | A | 6/1978 | Kiefer | 428/55 |
| 4,119,750 | A | 10/1978 | Porter | 428/105 |
| 4,179,540 | A | 12/1979 | Smarook | 428/71 |
| 4,196,251 | A | 4/1980 | Windecker | 428/311 |
| 4,223,053 | A | 9/1980 | Brogan | 428/35 |
| 4,262,052 | A | 4/1981 | Kannan et al. | 428/306 |
| 4,292,369 | A | 9/1981 | Ohaski et al. | 428/313 |
| 4,330,494 | A | 5/1982 | Iwata et al. | 264/46.2 |
| 4,361,613 | A | 11/1982 | Bogner et al. | 428/119 |
| 4,380,253 | A | 4/1983 | Mead et al. | 138/149 |
| 4,411,939 | A | 10/1983 | Hawkins et al. | 428/58 |
| 4,412,880 | A | 11/1983 | Wintermantel | 156/156 |
| 4,498,941 | A | 2/1985 | Goldsworthy | 156/148 |
| 4,521,266 | A | 6/1985 | Careddu | 156/242 |
| 4,536,427 | A | 8/1985 | Kohn | 428/44 |
| 4,608,103 | A | 8/1986 | Aldrich | 156/64 |
| 4,617,217 | A | 10/1986 | Michaud-Soret | 428/71 |
| 4,670,338 | A | 6/1987 | Clemino | 428/312.6 |
| 4,687,691 | A | 8/1987 | Kay | 428/73 |
| 4,807,969 | A | 2/1989 | Shimodaira et al. | 350/320 |
| 4,808,461 | A | 2/1989 | Boyce et al. | 428/119 |
| 4,823,534 | A | 4/1989 | Hebinck | 52/743 |
| 5,039,567 | A | 8/1991 | Landi et al. | 156/148 |
| 5,060,291 | A | 10/1991 | Albertelli | 428/306.6 |
| 5,087,500 | A | 2/1992 | Kasper et al. | 428/116 |
| 5,108,810 | A | 4/1992 | Williams | 428/36.1 |
| 5,182,150 | A | 1/1993 | Carlos et al. | 428/35.7 |
| 5,186,776 | A | 2/1993 | Boyce et al. | 156/73.2 |
| 5,197,928 | A | 3/1993 | Mishima et al. | 474/263 |
| 5,234,969 | A | 8/1993 | Clark et al. | 521/181 |
| 5,237,737 | A | 8/1993 | Zigler et al. | 29/598 |
| 5,462,623 | A | 10/1995 | Day | |
| 5,466,506 | A | 11/1995 | Freitas et al. | 428/105 |
| 5,589,015 | A | 12/1996 | Fusco et al. | 156/73.1 |
| 5,589,243 | A | 12/1996 | Day | 428/56 |
| 5,624,622 | A | 4/1997 | Boyce et al. | 264/258 |
| 5,625,999 | A | 5/1997 | Buzza et al. | 52/793.11 |
| 5,721,034 | A | 2/1998 | Seemann, III et al. | 428/71 |
| 5,741,574 | A | 4/1998 | Boyce et al. | 428/119 |
| 5,794,402 | A | 8/1998 | Dumlao et al. | 52/783.17 |
| 5,834,082 | A | 11/1998 | Day | |
| 5,904,972 | A | 5/1999 | Tunis, III et al. | 428/178 |
| 5,958,325 | A | 9/1999 | Seemann, III et al. | 264/510 |
| 6,159,414 | A | 12/2000 | Tunis, III et al. | 264/510 |
| 6,191,414 | B1 | 2/2001 | Ogle et al. | 250/227 |
| 6,655,633 | B1 | 12/2003 | Chapman | 244/123 |
| 6,676,785 | B2 | 1/2004 | Johnson et al. | 156/92 |
| 6,740,381 | B2 | 5/2004 | Day et al. | |
| 6,824,851 | B1 | 11/2004 | Locher et al. | 428/76 |
| 7,056,567 | B2 | 6/2006 | O'Neill et al. | 428/71 |
| 7,393,577 | B2 | 7/2008 | Day et al. | |
| 2004/0247856 | A1 | 12/2004 | Sikorski et al. | 428/318.4 |
| 2005/0019549 | A1 | 1/2005 | Tai et al. | 428/315.9 |

FOREIGN PATENT DOCUMENTS

| | | |
|---|---|---|
| CA | 2 725 735 | 12/2009 |
| DE | 1951310 | 4/1970 |
| DE | 1949209 | 4/1971 |
| DE | 19715529 | 8/1998 |
| EP | 0 569 846 | 11/1993 |
| FR | 1 596 868 | 6/1970 |
| GB | 245458 | 5/1926 |
| GB | 548027 | 9/1942 |
| GB | 559 527 | 2/1944 |
| GB | 1 265 835 | 3/1972 |
| GB | 1 375 877 | 11/1974 |

* cited by examiner

COMPOSITE CORES AND PANELS

FIELD OF THE INVENTION

This invention relates to composite sandwich panels comprising rigid skins separated by and bonded to generally lower density core materials. More specifically, the invention relates to sandwich panels having core panels comprising strips and/or blocks of at least two low density cellular materials of differing properties, and those strips and blocks extend between the panel skins in alternating configuration. The structural and other properties of the core panel are a composite of the differing properties of the cellular materials.

BACKGROUND OF THE INVENTION

Low density cellular materials commonly used as cores in structural composite sandwich panels are frequently not optimized for performance and/or cost for a given application. Variations in natural materials, such as balsa wood, require structural designers to assume the minimum properties of the material, and those cores usually have higher than required properties and also often have excessive weight. Additionally, the minimum structural properties of balsa wood sometimes greatly exceed the requirements of many weight sensitive composite applications, for example, the blades of wind turbines used to produce electrical energy, and these excess properties are accompanied by excess weight. Engineered foams such as PVC foams having generally isotropic properties are often over-designed for applications which do not require the same properties in all directions. The present invention provides a means of optimizing performance, weight and cost by combining two or more low density cellular materials to form a core panel having composite properties.

SUMMARY OF THE INVENTION

The core panels of the present invention comprise a plurality of alternating strips and/or blocks of at least two low density cellular materials which are adhesively connected to each other. Each of the strips and/or blocks extends between the side surfaces or faces of the core panel for connection by a hardenable adhesive resin to rigid sandwich panel skins, for example fiberglass reinforced plastic, aluminum or plywood, to form a composite sandwich panel.

In one embodiment of the invention, a core panel comprises strips of end grain balsa wood which are oriented with grain direction perpendicular to the faces of the core panel. These end grain strips alternate with strips of low density cellular plastics foam material having substantially lower structural properties and generally lower cost than the balsa wood. This assembly achieves composite structural properties lower than those of balsa wood alone but sufficient to satisfy the requirements of the intended application, which may include reduced cost and/or weight not attainable with balsa wood alone. The proportions and configuration of the balsa wood and low density foam are selected to achieve a specific resultant set of finished core panel properties. Engineered foam having substantial structural properties may be substituted for balsa wood. In an alternate embodiment of the invention, strips comprising plastics foam of low structural properties but having integral structural facers, such as fiberglass, extend between the faces of the core panel and may be substituted for the balsa wood or the high-performance foam strips.

DESCRIPTION OF THE PREFERRED EMBODIMENTS

Figure 1:
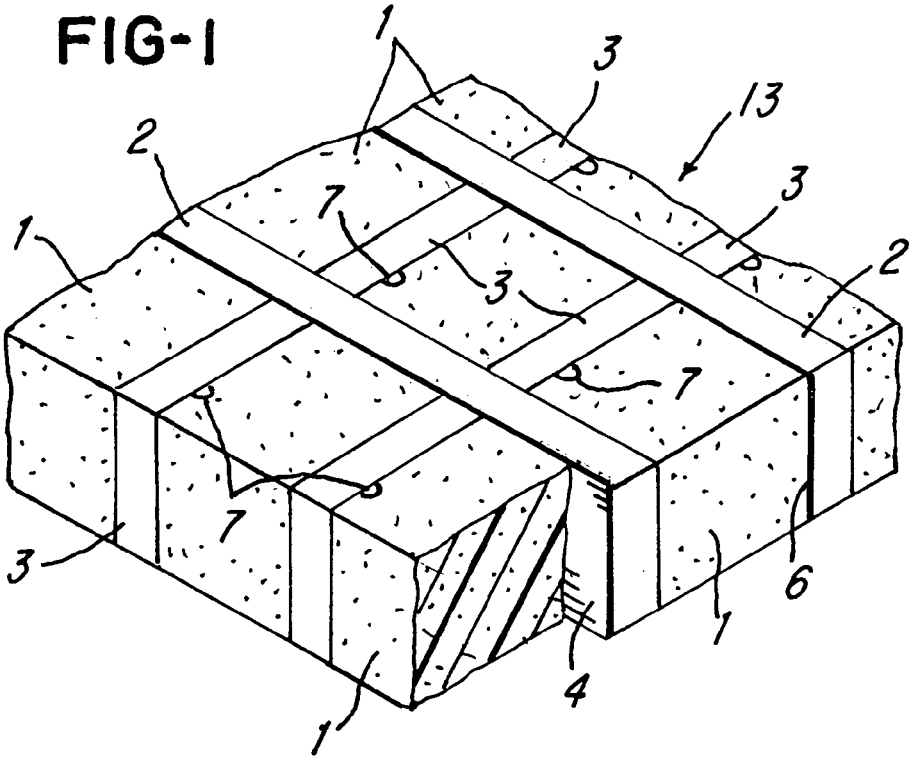
FIG. 1 is a fragmentary perspective view of a core panel constructed in accordance with the invention.

Referring to FIG. 1, reinforced core panel 13 includes blocks 1 of low density cellular foam, for example, polyisocyanurate plastics foam having a density of two pounds per cubic foot. Panel 13 also includes continuous parallel spaced elongated strips 2 of engineered higher density cellular material or plastics foam, for example PVC foam having a density of five pounds per cubic foot. The strips 2 are intersected by parallel spaced transverse engineered strips 3 of higher density cellular material such as the PVC foam material. The adjacent side, edge and end surfaces of the blocks 1 and strips 2 and 3 are connected together with layers of adhesive 6. Foam blocks 1 are generally of low structural properties and preferably of lower cost and weight per unit volume than engineered foam strips 2. Alternatively, engineered foam strips 2 and 3 may comprise a non-engineered foam, for example polyisocyanurate foam, as previously described, having integral structural facers 4 comprised of, for example fiberglass mat. Core panel 13 may be provided with grooves 7 which extend through the core to facilitate resin flow from one side surface of the core panel 13 to the other side surface during a molding process. It is understood that the transverse and discontinuous strips 3 of engineered foam may be omitted if it is desired to produce a core panel having primarily unidirectional structural properties.

Figure 2:
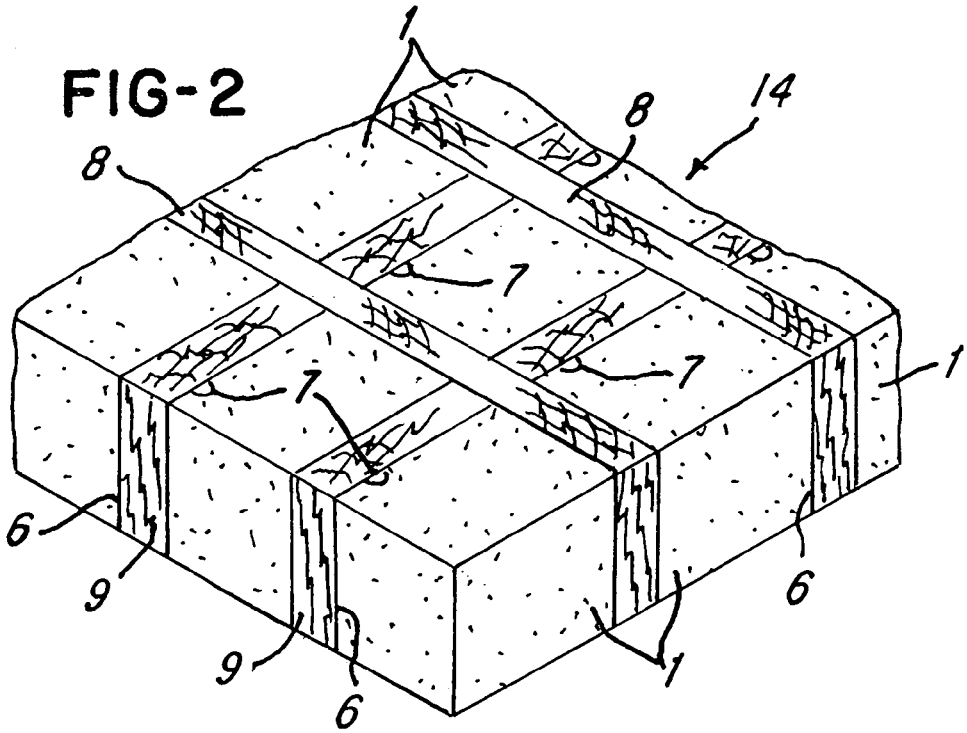
FIG. 2 is a fragmentary perspective view of a core panel constructed in accordance with another embodiment of the invention.

FIG. 2 illustrates a core panel 14 comprising blocks 1 of low density plastics foam material, continuous elongated and parallel spaced balsa wood strips 8 and interrupted parallel spaced transverse balsa wood strips 9 extending perpendicular to strips 8. The panel 14 has a configuration similar to that shown in FIG. 1, and the adjacent side, edge and end surfaces of the blocks and strips are connected together by adhesive layers 6. As mentioned above, foam blocks 1 are generally of low structural properties and preferably of lower cost and lower weight per unit volume than balsa strips 8 and 9. The cell alignment and structural properties of the balsa strips are highly directional, and balsa strips 8 and 9 are oriented with grain direction perpendicular to the opposite side surfaces or faces of core panel 14, as shown in FIG. 2, to provide optimum strength and stiffness to the sandwich panel. Core panel 14 may be provided with grooves 7 which extend through the thickness of the panel to facilitate resin flow from one side surface or face of core panel 14 to the other side surface or face during a molding process. It is understood that the transverse balsa strips 9 may be omitted if it is desired to produce a core panel having primarily uni-directional structural properties.

A particular economic advantage of the bi-directional core panel shown in FIG. 2 is that the balsa wood forming transverse strips 9 is purchased in its long-grain or natural wood form, rather than its manufactured, or end-grain form which requires extensive processing, for example, as described in U.S. Pat. No. 4,122,878. In core panels constructed in accordance with the present invention, strips 9 of low-cost long-grain balsa wood are re-oriented to end-grain configuration within core panel 14 by adhesively connecting alternating strips of long grain balsa and low density foam, cutting the resulting panel transversely into a plurality of strips, rotating the strips 90 degrees, and adhesively connecting the strips between continuous parallel spaced alternating strips 8 of end-grain balsa wood.

While the forms of a core panel herein described constitute preferred embodiments of the invention, it is to be understood that the invention is not limited to these precise forms of a core panel, and that changes may be made therein without departing from the scope and spirit of the invention as defined in the appended claims.

What is claimed is:

1. A composite core panel having an upper core surface and a lower core surface comprising:

a plurality of six-sided blocks of cellular material, and wherein each block has an upper surface facing the upper core surface of the core panel, a lower surface facing the lower core surface of the core panel, and four side surfaces extending between the upper surfaces and the lower surfaces of the blocks, a plurality of elongated primary strips of structural cellular material having a density greater than the density of the cellular material of the blocks, wherein the elongated primary strips have a pair of side surfaces, a pair of to surfaces, and a pair of end surfaces, wherein the primary strips are arranged such that the side surfaces of the primary strips are adjacent the side surfaces of the blocks and the to surfaces of the primary strips face the upper core surface and lower core surface of the core panel, wherein the top surfaces of the primary strips are flush with the upper and lower surfaces of the blocks, a plurality of elongated secondary strips of structural cellular material having a density greater than the density of the cellular material and extending in a transverse relationship to the primary strips, wherein the secondary strips have a pair of side surfaces, a pair of to surfaces, and a pair of end surfaces, wherein the end surfaces of the secondary strips are adjacent the side surfaces of the primary strips, and wherein the side surfaces of the secondary strips are adjacent the side surfaces of the blocks; and adhesive located between and adhesively attaching the side surfaces of the blocks and the side surfaces of the primary strips, between the side surfaces of the blocks and the side surfaces of the secondary strips, and between the end surfaces of the secondary strips and the side surfaces of the primary strips.

2. The core panel of claim 1, wherein the primary strips and the secondary strips comprise balsa wood.

3. The core panel of claim 1, wherein the primary strips and the secondary strips comprise a structural plastics foam material.

4. The core panel of claim 2, wherein each of the strips of balsa wood has end grain extending between the end surfaces of each strip.

5. The core panel of claim 1, wherein the blocks further comprise grooves which extend from the upper surface of the block to the lower surface of the block.

* * * * *

UNITED STATES PATENT AND TRADEMARK OFFICE

CERTIFICATE OF CORRECTION

PATENT NO. : 8,389,104 B2
APPLICATION NO. : 12/924612
DATED : March 5, 2013
INVENTOR(S) : Day et al.

It is certified that error appears in the above-identified patent and that said Letters Patent is hereby corrected as shown below:

In the Claims:

In column 3, line 23, after the word "of" delete the word "to" and replace with the word "top".

In column 3, line 27, after the word "the" delete the word "to" and replace with the word "top".

In column 4, line 5, after the word "of" delete the word "to" and replace with the word "top".

Signed and Sealed this
Thirtieth Day of April, 2013

Teresa Stanek Rea
*Acting Director of the United States Patent and Trademark Office*